United States Patent [19]

Reichel

[11] Patent Number: 5,023,965

[45] Date of Patent: Jun. 18, 1991

[54] SHOWER UNIT PANEL

[76] Inventor: Gunter Reichel, Kreuzstrasse 19, D-3563 Dautphetal 5, Fed. Rep. of Germany

[21] Appl. No.: 421,676

[22] Filed: Oct. 12, 1989

[30] Foreign Application Priority Data

Mar. 11, 1989 [DE] Fed. Rep. of Germany ... 8903013[U]
Aug. 3, 1989 [DE] Fed. Rep. of Germany ... 8909357[U]

[51] Int. Cl.[5] ..... A47K 3/22; A47K 3/08

[52] U.S. Cl. ..... 4/607; 4/557; 4/612

[58] Field of Search ..... 4/557, 607, 612, 614; 49/470, 476, 482

[56] References Cited

U.S. PATENT DOCUMENTS

| | | | |
|---|---|---|---|
| 1,944,440 | 1/1934 | Lehman | 4/607 |
| 2,032,180 | 1/1932 | McCord | 4/609 |
| 3,504,456 | 4/1970 | Frederick | 49/470 |
| 3,869,735 | 3/1975 | D'Amato | 4/607 |
| 3,913,171 | 10/1975 | Reid | 16/375 |
| 4,606,084 | 8/1986 | Baus | 4/607 |
| 4,856,126 | 8/1989 | Baus | 4/607 |

*Primary Examiner*—Henry J. Recla
*Assistant Examiner*—David J. Walczak
*Attorney, Agent, or Firm*—Fred Philpitt

[57] ABSTRACT

The invention provides a panel (10) for adjustable attachment to a mounting section (12) relative to which it is hinged or slidable. It includes a glass or plastics pane (50) and at least one profiled ledge (22) as an integral component of straight, angled [-shaped structure. The bottom ledge (22) encloses the bottom edge (21) of the pane (50) and supports a sealing strip (26) having a stiff base (28, 76) with at least one flexible lip (32). A profiled front ledge (23) may extend up to a handle (42) or way up to an upper pane edge (81). At the inside face at least of the profiled bottom ledge (22), there is a hollow sloping drain channel (44) leading back into the interior of a panel-made shower unit. The profiled ledges (22, 23, 82, 92) are preferably non-metallic resilient components with or without reinforcement insets (70). Two associated panels (10, 100) may form a round or corner-type shower unit closed by magnetic sealing gibs (46).

14 Claims, 8 Drawing Sheets

G-G

H-H

J

K-K

M-M

L-L

SHOWER UNIT PANEL

FIELD OF THE INVENTION

The invention relates to a panel according to the generic part of claim 1. Such panels are especially useful for the doors or walls of shower units such as cabinets of partitions.

BACKGROUND OF THE INVENTION

Since partitions are not only required in bathrooms, but generally in moist sections of premises, they usually include a frame having sealing means for preventing the penetration of water into areas that are intended to be kept dry. Typical structures comprise a vertical mounting section for supporting the door or wall panel which may include a glass or plastics pane and which is often hinged or slideable. Conventional partitions employ light metal components such as extruded aluminium profiles of suitable lengths which are joined or mitred to form a frame that holds the pane. Typical examples are disclosed in DE-U-7031717 and DE-U-7336675. In addition to special profile designs, it is necessary to have further fasteners, mounting devices, etc. in order to obtain sufficiently strong corner joints. With mitring, the installation at the site may pose problems if the conditions prevailing necessitate larger tolerances. Even where the inevitable juncture seams are well smoothed for prevention of injuries, it is possible that impurities accumulate. It is also less economical, and sometimes detrimental to use, that the profiles required may be rather wide which also detracts from appearance and increases the total weight.

It has been attempted to avoid frames by using the panes of glass or of plastics themselves as panels. Due to the fact that sliding doors require shiftable suspension means, the realization of such panel structures, which are rather heavy, has more or less been restricted to swing doors. Fairly high prices may govern buying decisions for these; and in practical use, edge protection is of the essence.

OBJECTS OF THE INVENTION

Within the need for further development, it is an important object of the invention to overcome drawbacks of the prior art and to create a novel panel of simple yet sturdy design.

Another object of the invention is an advantageous design of a panel such that it may be serviced and cleaned with ease for optimum hygiene.

The invention further aims at providing a panel structure that is open to various approaches of design and production.

Still another object of the invention is the best possible prevention of water penetration from within a shower unit provided with panels having particular sealing means.

SUMMARY OF THE INVENTION

In accordance with the invention, a bottom edge and at least part of a front edge of the pane are bordered by at least one profiled ledge which is an integral component of straight, angled or [-shaped structure and which may be of substantially lenticular cross section. Preferably, it carries a vertically adjustable sealing strip in a downwardly open longitudinal recess. The profiled ledge is easily affixed to the pane by clamp fit and/or by adhesion. There are no mitres or parting seams on profiled components which fact does away with conventional difficulties to properly seal and clean frame corners. The profiled ledge of the invention is rather flat and provides solid grip of the pane. Being softly rounded, as a rule, on both the outer and inner faces, the profiled ledge contributes much to a pleasing appearance of the panel. Factory storage is greatly enhanced as any dimension can be obtained by cutting standard profile material to suitable lengths. An important advantage to the user results from the abolition of any threshold that customarily had to intercept water and collect it within a shower unit. This effect is achieved here by lips of the sealing strip that may be integral with the profiled bottom ledge or may be readily mounted thereto.

Advantageously, the novel panel may at its inside be provided with at least one drain channel that is slanted or curved so as to lead back into the interior of the shower unit. The drain channel may be mounted permanently or detachably, and it may provide or include a reinforcement to the profiled ledge. A transition section of oblique or hollow shape connects drain channel portions at the front and bottom ledges for fast flowback of water that gradually gathers at the inside panel surface as the shower is being used. This will actively prevent any flooding of the floor space in front of the shower unit once its door is opened. The risk of accidents by slipping will be still further reduced by a lower or inner deflector at the drain channel so that overflowing water is diverted towards the interior of the shower unit. A snap or clamp-fit connection of the drain channel allows quick take-off, e.g. for cleaning purposes or for exchange by another type of channel. It will be realized that the drain channel, whether or not permanently molded to the profiled ledge, also provides additional and effective edge protection to the pane of glass or plastics in a zone that is prone to foot exposure.

Further in accordance with the invention, a profiled ledge may extend over part or all of the front edge of the panel so as to protect it. Easy operation is obtained by a handle that may be molded to the profiled front ledge, especially at or above its vertical center. A like profiled ledge can also be provided at the top and/or at the mounting edge of the panel.

It is particularly expedient if the profiled ledges are adapted to be bent to a shape matching that of the pane or of a shower basin. This will be assisted by an imbedded reinforcement such as a strap hinge. The unique design of the invention permits the use of one and the same profile components for both straight and curved shower units, with optimum adaptation to existing facilities, e.g. bath tubs. Either in the factory or on the site, it is possible to bend the profiled bottom and top ledges to any conventional curvature the pane or the basin may require. The installation of round shower units may be facilitated by associated guide profiles of like shape and curvature.

If there is a magnetic gib retained at the front edge of the panel, the construction and use of a shower unit will be promoted since, in particular, two neighboring panels whose front edges match sealingly may thus form a corner-type or round shower unit. Larger partitions are obtained by associating to each panel an extension panel for continuing or straightening the panel contour towards an adjacent wall.

The vertical mounting section preferably includes a wall fixture and a sealed or sealing cover that is depthadjustable thereto, and there may be an adjustable door opening stop. These features contribute to solid installation and safe use of shower units equipped with the novel panels.

Each profiled ledge may be unilaterally affixed to the pane, e.g. by molding the ledge material thereto in a single process, with the respective ledge enclosing the associated pane edge. A sealing strip arranged along the profiled bottom ledge may include two lips of unequal lengths and compliances that are joined at a common broad base of increased stiffness. The location of the sealing strip relative to a central plane, e.g. that of the pane, may be varied by offsetting or bending-off in order to achieve good adaptation to prevailing conditions.

Optimum results are obtained if the profiled ledges are resilient non-metallic component parts. Suitable materials are expanded polyurethane, hard rubber or the like. However, the invention also envisages the use of corrosion-protected metal component parts whereby the profiled ledges may be of light metal, stainless steel, etc. Their mounting will be much enhanced by a twin structure such that an outer shell and an inner shell are form-fitted to interlock, and the respective profiled ledge may be sandwiched around the panel edge with or without an intermediate layer of a resilient or sealing material.

Further specializations, embodiments, modifications, details and advantages of the invention will become evident from the

ANNEXED DRAWINGS

Wherein.

Figures 1, 2, 3:
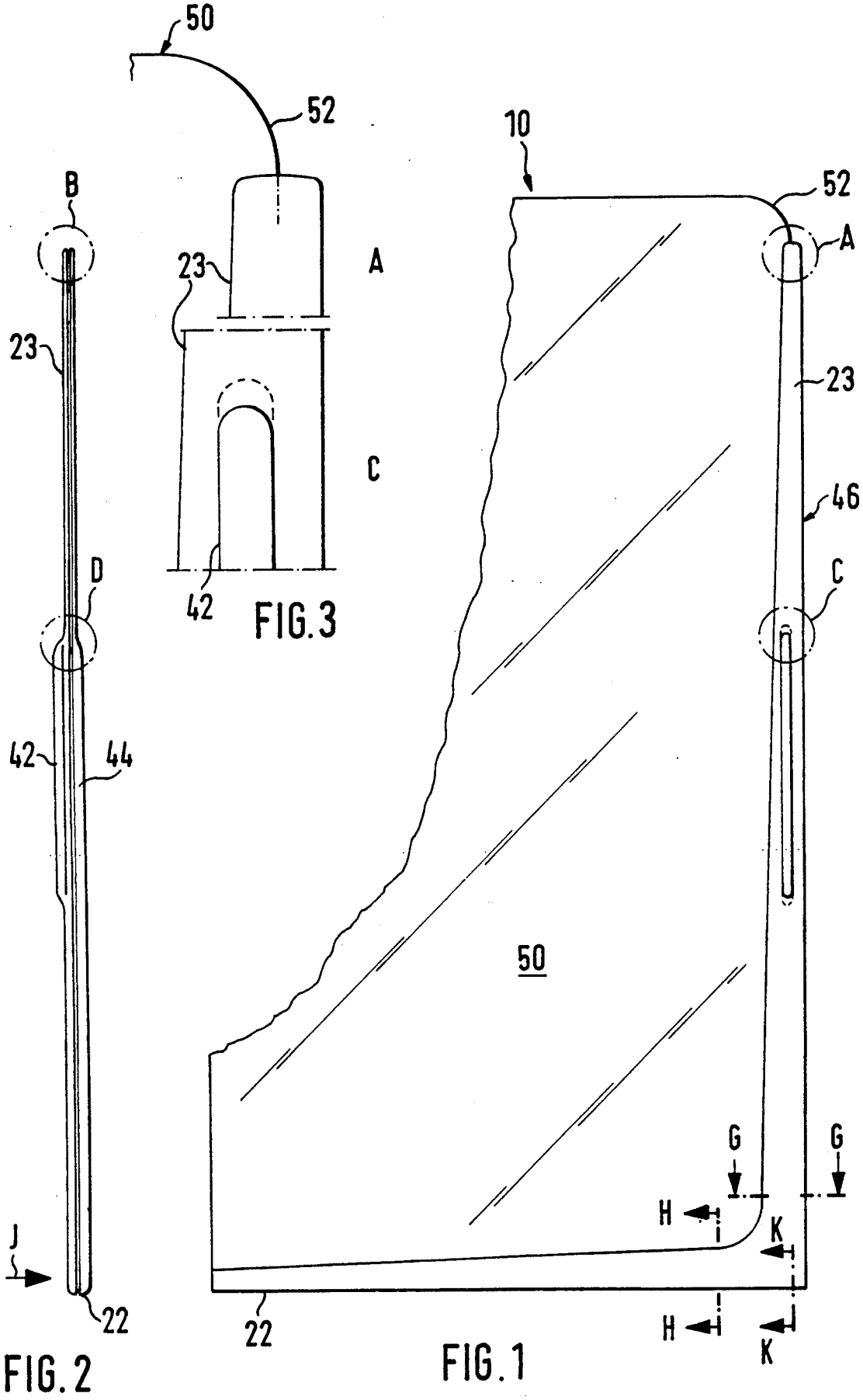
FIG. 1 is a partial front elevation of a panel according to the invention.
FIG. 2 is a front view of the panel shown in FIG. 1.
Figure 4:
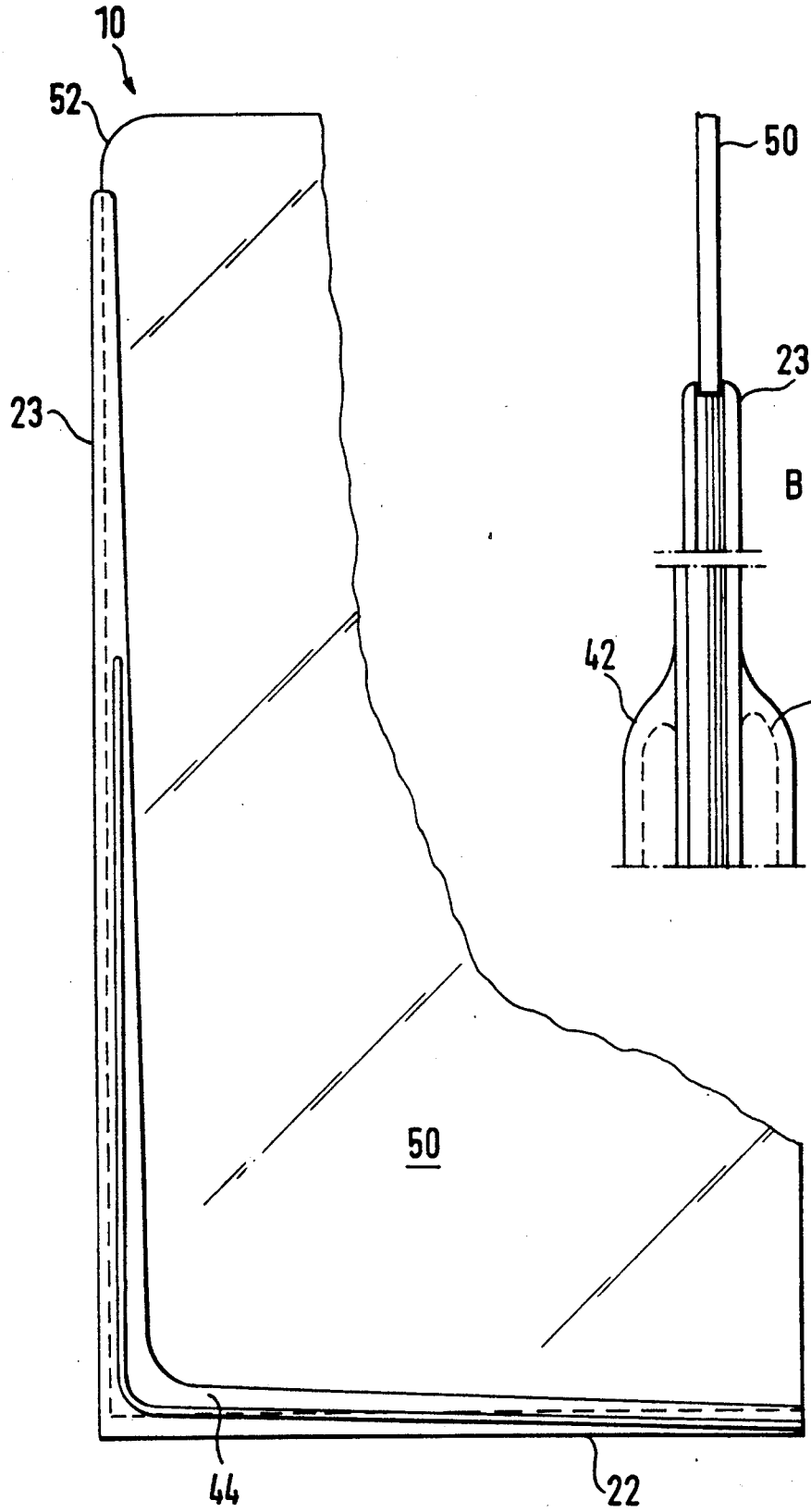
Figure 5:
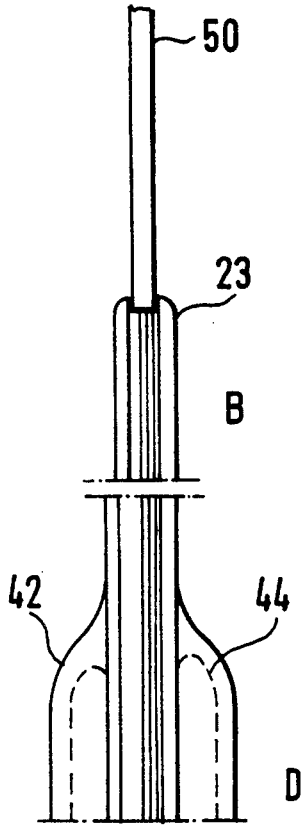
Figure 6:
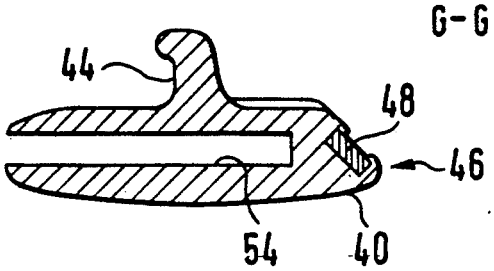
Figure 7:
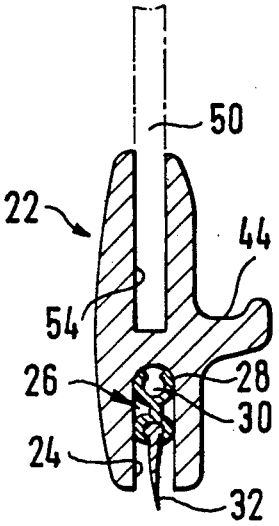
Figure 8:
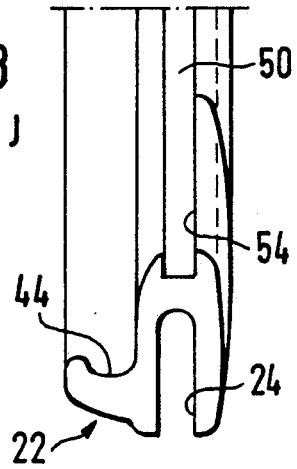
Figure 9:
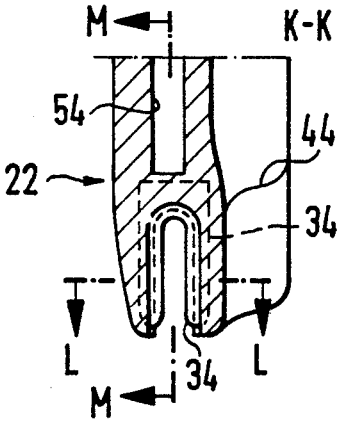
Figure 11:
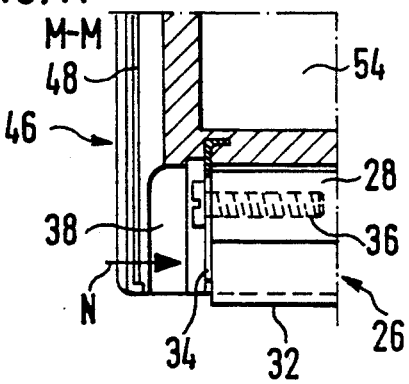
Figure 12:
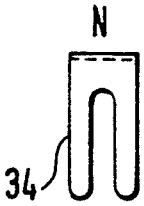
Figure 10:
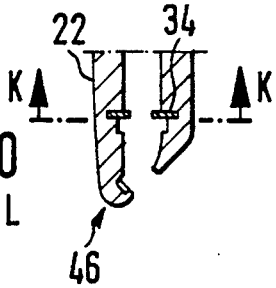
Figure 16:
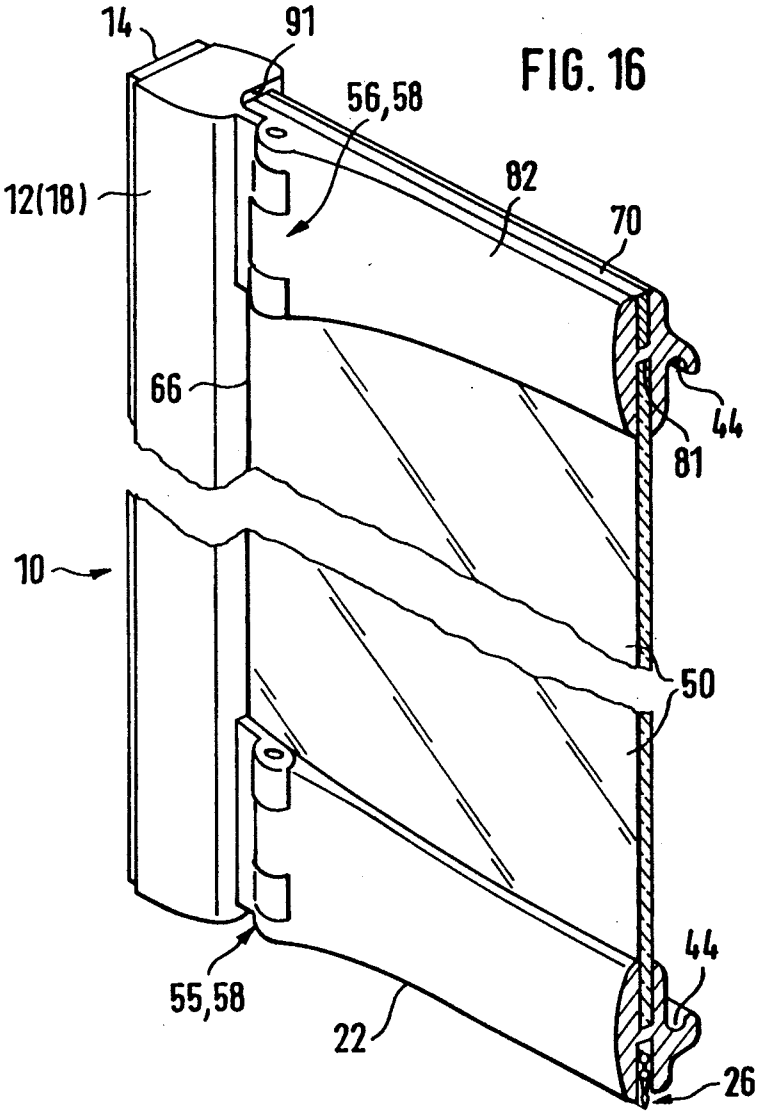
Figure 15:
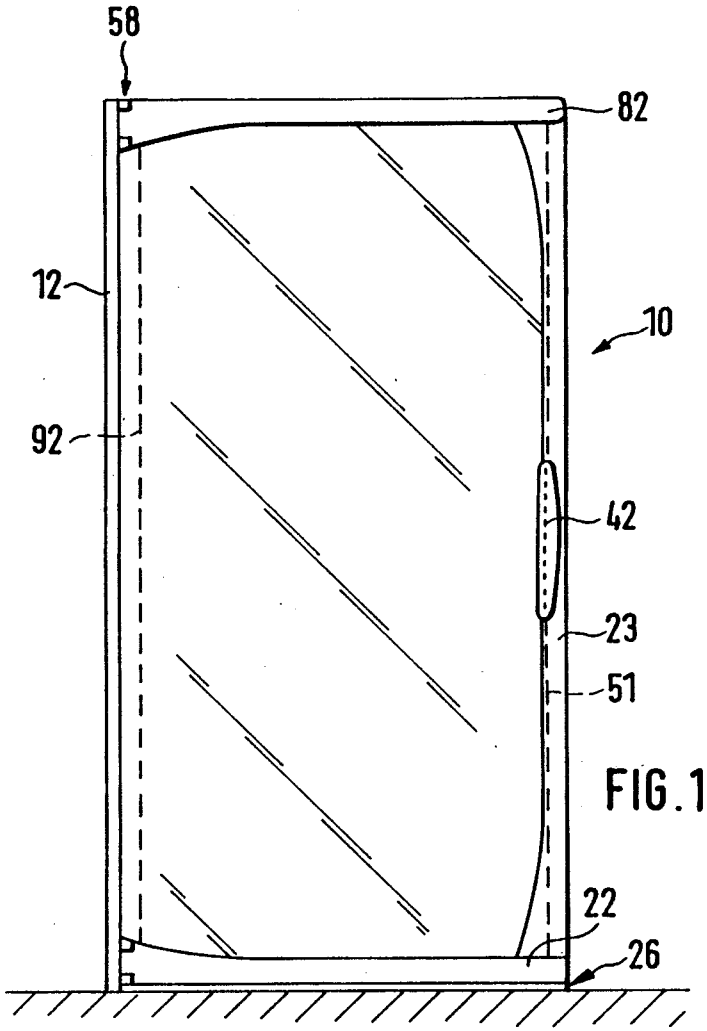
Figure 17B:
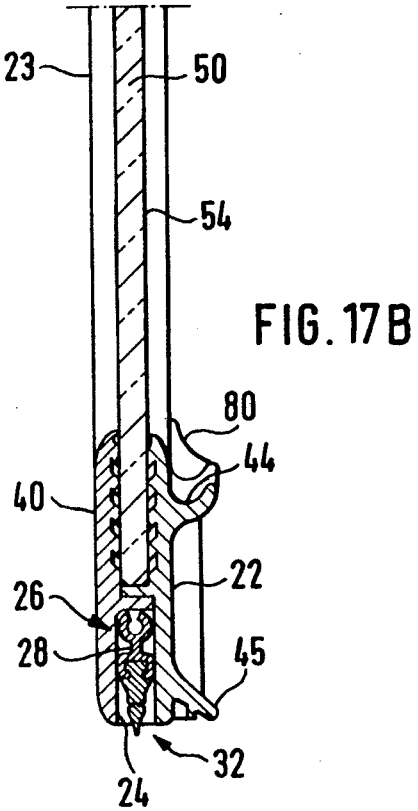
Figure 17A:
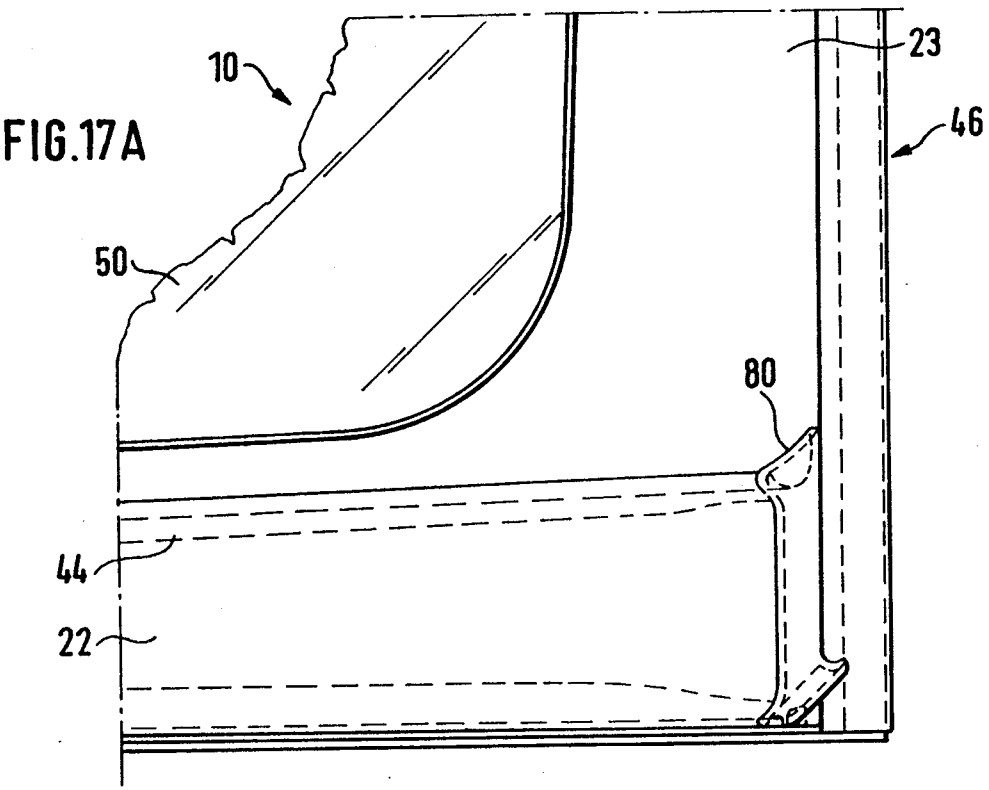
Figure 17C:
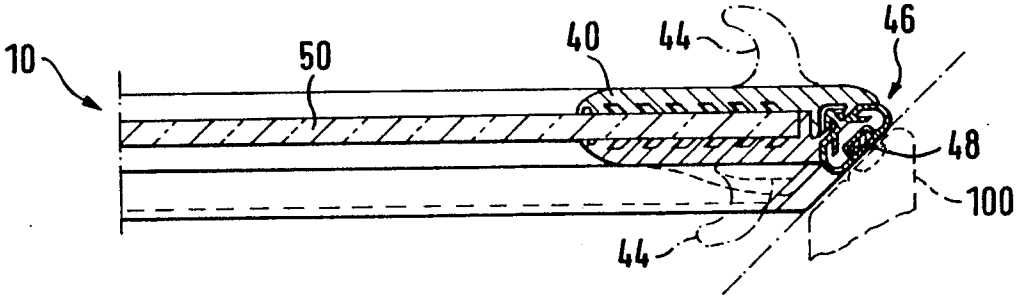
Figure 18:
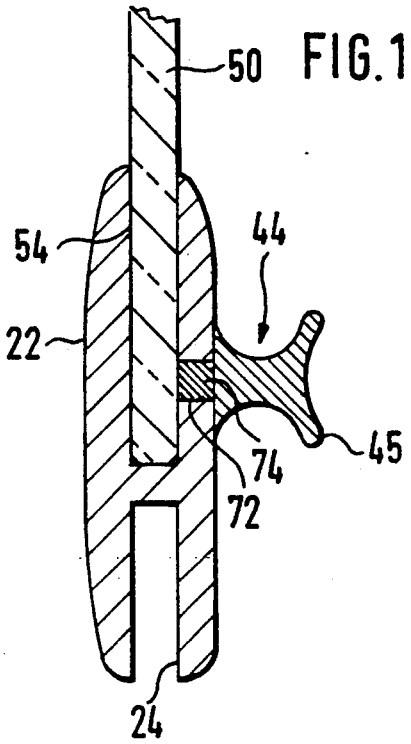
Figure 19:
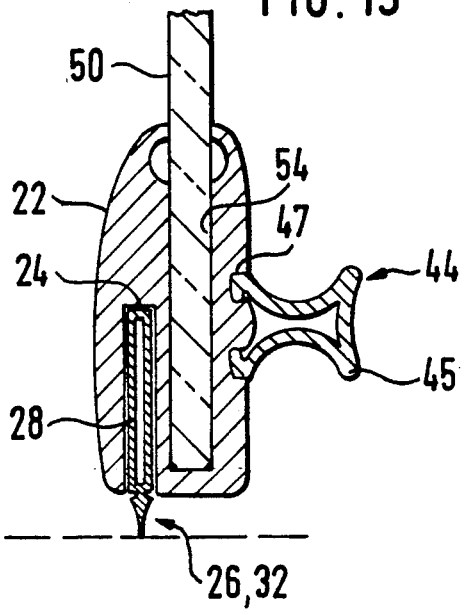
Figure 20A:
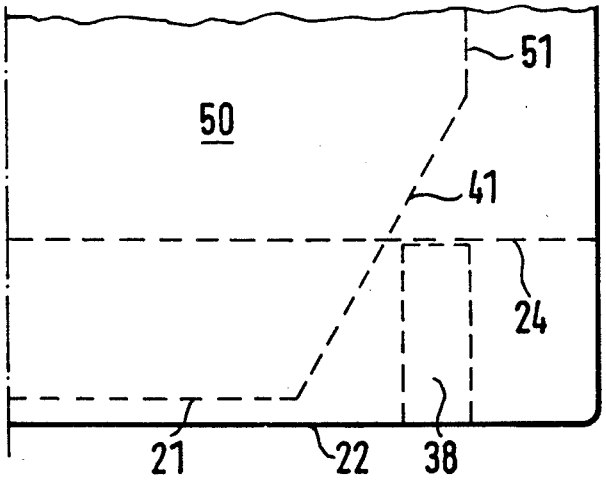
Figure 20B:
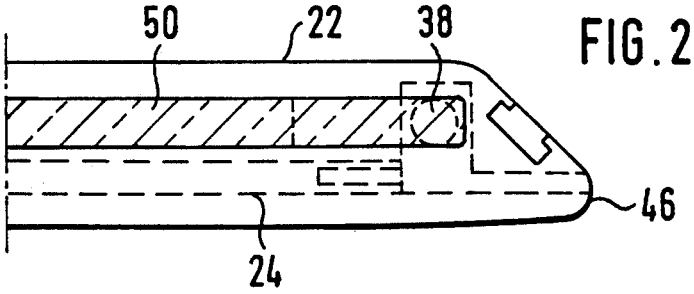
Figure 21:
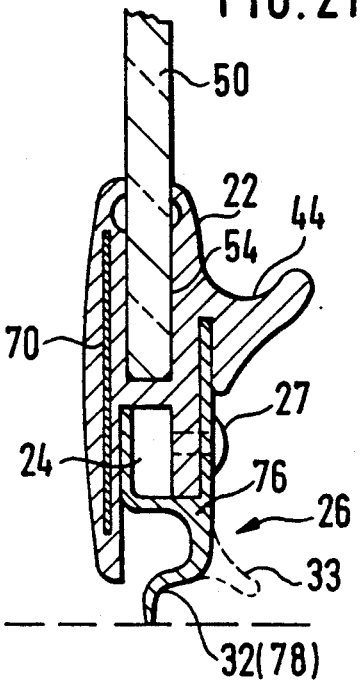
Figure 22:
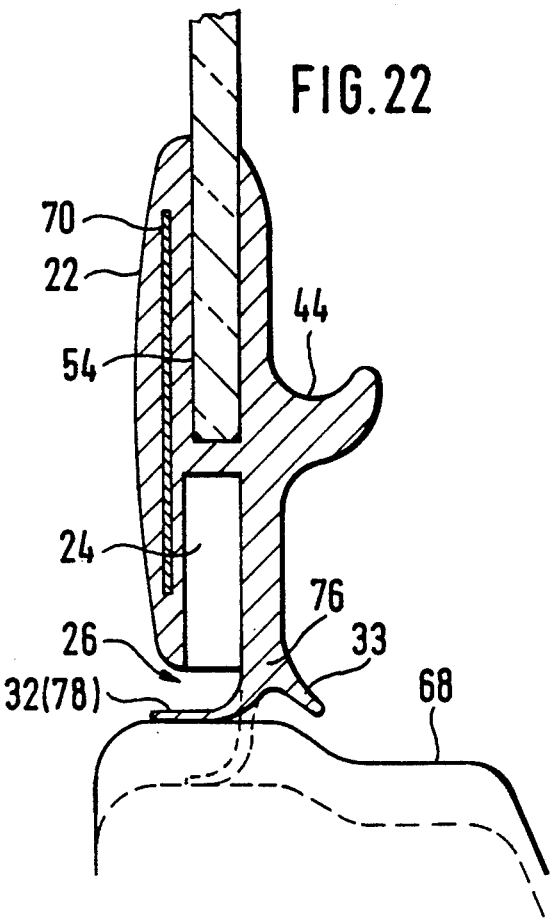
Figure 23A:
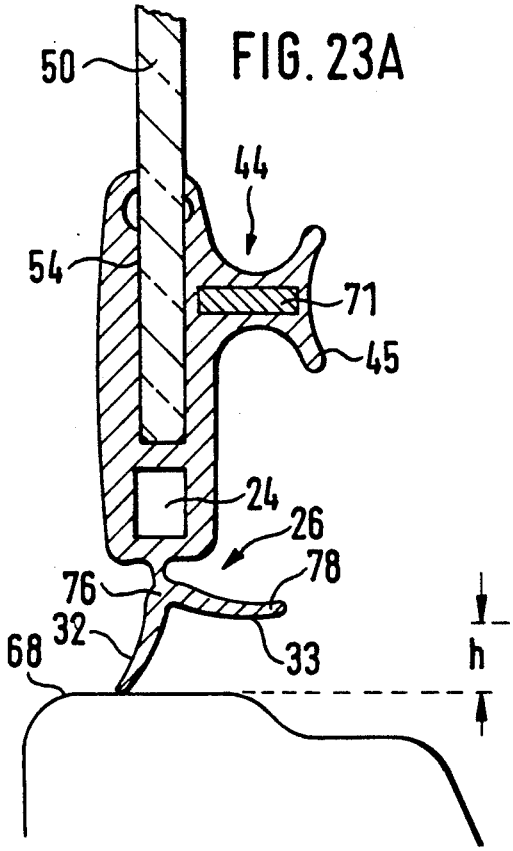
Figure 23B:
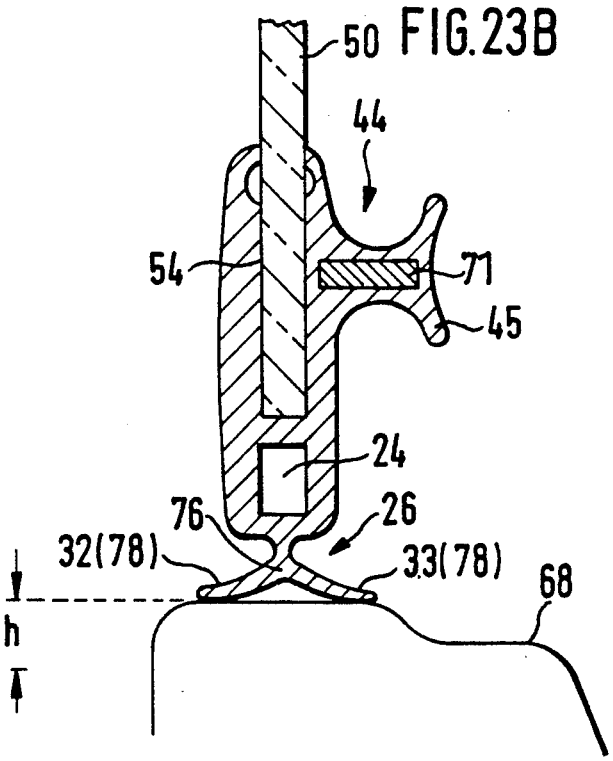

FIG. 3 is an enlarged side view corresponding to circles A and C in FIG. 1, FIG. 4 is a partial rear elevation of the panel shown in FIG. 1, FIG. 5 is an enlarged front view corresponding to circles B and D in FIG. 2, FIG. 6 is an enlarged cross section corresponding to line G in FIG. 1, including a gib inset, FIG. 7 is an enlarged cross section of a profiled bottom ledge corresponding to line H in FIG. 1, FIG. 8 is an enlarged view of a bottom ledge end corresponding to arrow J in FIG. 2, FIG. 9 is an enlarged sectional view of a bottom ledge corresponding to arrow K in FIG. 1 and to line K in FIG. 10, FIG. 10 is an enlarged sectional view corresponding to line L in FIG. 9, FIG. 11 is a partial side elevation corresponding to FIG. 9, partly in section according to line M thereof, FIG. 12 is a front view of a latch plate, FIG. 13 is an enlarged partial view of a lower corner portion of a panel according to FIGS. 1 and 2, FIGS. 14*a* and 14*b* are partially sectioned top views of the corner shown in FIG. 13, in two different positions, FIG. 15 is a front elevation of another panel, FIG. 16 is a perspective view of an upper corner portion of the panel shown in FIG. 15, FIG. 17*a* is a partial front elevation of a lower front corner of another panel, FIG. 17*b* is a side view of the corner shown in FIG. 17*a*, FIG. 17*c* is a top view, partially sectioned, of the panel portion shown in FIG. 17*a* together with part of an associated second panel, FIG. 18 is a partial sectional view of a profiled ledge with a drain channel, FIG. 19 is a view similar to FIG. 18 but showing a different embodiment, FIG. 20*a* is a schematic partial side elevation of a lower front corner of a panel, FIG. 20*b* is a top view, partially sectioned, of the panel corner shown in FIG. 20*a*, FIGS. 21 and 22 are partial sectional views similar to FIGS. 18 and 19 but of modified types, and FIGS. 23*a* and 23*b* are partial sectional views of profiled ledges similar to FIGS. 22 and 18, respectively, at different heights relative to a tub top.

The front and rear sides of a panel generally designated by 10 are shown in FIGS. 1 and 4, respectively, with part of a glass or plastics pane 50 being broken off for the sake of space economy. The upper front corner of the pane 50 has a curved portion 52 leading to a lateral component shaped as a profiled front ledge 23 which continues at a right angle thereto by way of a profiled bottom ledge 22. A handle 42 that is integral with the profiled front ledge 23 is arranged at about the vertical center of the panel 10.

At the inside of the panel 10, i.e. towards the interior of a shower unit made with it, there is a drain channel 44 that runs slightly inclined downwardly as well as backwardly for easy flow-back of splashed water into said interior. It will be seen from FIGS. 2 and 4 that the drain channel extends up to about the vertical center of the panel 10 and also forms a handle structure by which the panel door may be opened and closed, respectively, from inside. More particularly, FIG. 5 shows the transition of the drain channel 44 into a rail-type handle similar to handle 42 at the outside.

Details of the structure will be evident from FIGS. 6 to 12 discussed now. Reference is had to areas or sections designated by the respective capital letters in FIGS. 1 to 5. Thus FIG. 6 shows a section along plane G in FIG. 1 and elucidates the shape of the profiled front ledge 23 near its bottom end, with the hollow drain channel 44 just above a curved portion adjoining the profiled bottom ledge 22 (FIG. 1). Towards a front edge 46 of the profiled front ledge 23, it holds a magnetic gib 48 designed to cooperate with a like magnetic gib (see FIG. 17*c*) of a second panel 100.

FIGS. 7 to 12 feature a preferred embodiment of the profiled bottom ledge 22 which includes, in its upper portion, a retainer groove 54 for receiving the pane 50. Essentially in alignment with the retainer groove 54, the profiled bottom ledge 22 has in its lower portion a longitudinal recess 24 that opens downwardly to receive a sealing strip 26 (FIG. 7). The latter consists of a support 28 having screwing apertures 30 and of at least one lip 32 that is clamped by a broader base of the support 30. A ∩-shaped latch plate 34 is adapted to be inserted into the profiled bottom ledge 22 transversely thereto, i.e. in the plane of FIGS. 9 and 12. The latch plate 34 forms an angle piece (see FIG. 11) having legs with a slit in between (FIG. 12) through which passes a fixing screw 36 screwed into aperture 30 of the sealing strip 26. A plug 38 closes the face ends of the longitudinal recess 24. It will be realized that the latch means 28/30/34/36 permit easy adjustment for proper height and, if need be, for proper angle as required by local installation conditions.

A mounting section 12 is provided for attaching the panel 10 to an adjacent wall (not shown) by means of a wall fixture 14 and of a hinge structure 56/58. As seen in FIGS. 13, 14*a* and 14*b*, the wall fixture 14 comprises setscrews 16 arranged near the panel top and bottom, respectively. A capping or cover 18 forms a hood for the wall fixture 14 to which engaging edges 64 extend sealingly by form-fit. A sealing strip 66 that may be integral with either the cover 18 or with the hinge structure 56/58 serves for connection to the glass or plastics pane 50. The latter is held by hinge plates 56 which cooperate with hinge pins 58. Plug 38 closes mounting apertures of the profiled bottom ledge 22 at the hinge end of it (FIG. 13).

The wall fixture 14 and a wall bracket 62 are fixed to a wall by suitable means such as dowel screws. The setscrews 16 permit an adjustment of the distance of cover 18 and thus of hinge structure 56/58 to the wall surface. FIG. 14*a* shows a position near the latter, whereas a larger distance due to setscrew 16 being extended is seen in FIG. 14*b*. Access to the setscrews 16 is gained through sealable openings (not shown) in cover 18. An adjusting device 60 allows of vertical setting so that the panel 10 can be adapted to virtually any given building condition.

The invention is not limited to the embodiments described thus far. As seen in FIGS. 1 and 4, the glass or plastics pane 50 has a free upper edge ending with curvature 52. However, said upper edge—designated by 81 in FIG. 16—may also be enclosed and protected by a profiled upper ledge 82 (FIG. 15), and further profiled ledges 23, 92 may be provided at the front and rear edges 51 and 91, respectively, of the panel 10. An embodiment not shown includes a [-shape of the upper, front and bottom ledges by way of a unitary ledge structure enclosing the pane edges whereby the horizontal and vertical ledge portions are integrally connected to form a smooth design that provides protection to all the exposed panel edges.

The embodiment of FIGS. 15 and 16 features a profiled upper ledge 82 that is mirror-inverted- but otherwise identical to the profiled bottom ledge 22. Both these ledges 22, 82 include the hinge structure 56/58 that here comprises a reinforcement inset 70 which is preferably of metal to provide additional strength. Such reinforcements are preferably flexible to permit bending, either in the factory or on the site, to any conventional curvature desired. For example, the upper and bottom ledges may be curved to receive a pane 50 of like curvature. Where a pane 50 of flexible material is used, the unique features of the invention make it possible to do all the bending in a single process.

It should be noted that while the profiled ledges illustrated are of unitary structure, they may also be made up by an outer shell and an inner shell each (not shown) adapted to be form-fitted to each other, e.g. to be snap-locked with or without an intermediate resilient layer so as to grasp the pane 50 therebetween in a twin structure thus formed.

Yet another embodiment comprises profiled front ledges or ledge portions which need not extend over all the front edge 51 but may reach up to a handle 42 that is preferably fixed to the panel 10 at about its vertical center. Various views of the lower front corner of a panel 10 are shown in FIGS. 17*a*, 17*b* and 17*c*, respectively. Again, the profiled bottom ledge 22 encompasses the pane 50 in a retainer groove 54. Towards the shower unit interior, the bottom ledge 22 includes a softly sloping drain channel 44 that comprises a transition section 80 for smooth closure towards the front edge 46. The latter is, in particular, formed by a rounded though acute-angled profile which houses a magnetic gib 48. Where a corner shower unit is constructed, an associated second panel 100 may hold a like magnetic gib to provide a sealed compartment; its closing plane is indicated by a dash-dot line in FIG. 17*c*.

An embodiment of the profiled bottom ledge 22 is seen in FIG. 18 to include a detachable drain channel 44 having a lower deflector 45 by way of a lower edge directed towards the shower unit interior. Dogs 74 on the drain channel 44 and preferably integral therewith may be form-fitted into holes 42 at the inner side of the bottom ledge 22. Other fixing means may be used selectively or additionally, such as screwing, adhesives etc.

In the design of FIG. 19, the profiled bottom ledge 22 has at its inside recesses that match corresponding projections of the drain channel 44 by which the latter is fixed. It will be noted that the planes of retainer groove 54 and of pane 50 on the one hand and of longitudinal recess 24 for the sealing strip 26 on the other hand are offset so that the overall height of the bottom edge 22 is reduced. The sealing strip 26 is, in particular, slightly displaced towards the outside of the panel.

The schematic views of FIGS. 20*a* and 20*b* show the lower front corner of the panel to include an angle corner 41, especially oblique or slanted to provide space for a front sealing plug 38 in the profiled bottom ledge 22.

Another example of a profiled bottom ledge 22 is shown in FIG. 21 wherein the longitudinal recess 24 and the retainer groove 24 are in alignment. In the outside facing portion of the bottom ledge 22, there is a reinforcement inset 70 that may be a glass fabric, a metal net or the like. The outside face of the ledge 22 extends farther downward that its inside portion to which the sealing strip 26 is attached by holding means 27 such as bolting or snap-lock fasteners. The sealing lip 32 is bent off towards the center plane and forms a rather flexible contact portion 78 which widens somewhat towards the lip base 76.

A similar design is evident from FIG. 22 although here, the inside face of the profiled bottom ledge 22 is integral with the sealing strip whose broad base 76 splits up at the transition to an inner lip 33 and the outer lip 32 which is longer and more flexible than the inner lip. The purpose of this will be clear if the distance to an upper tub rim 68 is considered whereon the longer lip 32 will still provide contact even if the shorter lip 33, which acts as a deflector edge, should be out of contact with the tub rim 68.

In the embodiment of FIGS. 23*a* and 23*b*, the lips 32, 33 of the sealing strip 26 are arranged near the center plane of the pane 50 in the lower region of the longitudinal recess 24 that may be partly closed. It will be realized that with identical mounting of the panel 10, there is ample room for compensating height differences h towards the upper tub rim 68 which may be engaged by only one lip or by both lips, as the case would be.

Further with regard to FIGS. 23*a* and 23*b*, the drain channel 44 shown here to be integral with the bottom ledge 22 encloses a reinforcement inset 71 arranged in a plane transverse to that of the pane 50. Inset 71 may be a metallic rib which comprises pins or other projections for locking or securing it within the drain channel 44.

The shape of the profiled ledges 22, 23, 82, 92 may slightly differ in the various embodiments but always is of smooth contour to provide an even (if somewhat curved) surface that is apt to be cleaned easily and cannot cause any injury. The finish of the ledges may be selected as desired, and any color can be chosen. The drain channel 44 serves to greatly enhance hygienic conditions in any room where a shower unit with the panel according to the invention is used. Its profiled ledges provide optimum protection both to the user and to the panel edges. Where bent structures are employed, no leakage problems are posed, either.

While preferred embodiments have been illustrated and explained hereinabove, it should be understood that numerous variations and modifications may be apparent to one skilled in the art without departing from the principles of the invention which, therefore, is not to be construed as being limited to the specific forms described.

I claim:

1. A panel for the closure of shower units and the like that has a front side and a back side and which is adapted to be vertically mounted by a hinged supporting means, said panel including (a) a pane (50) having a front side and a backside as well as top, bottom, inner and outer edges, (b) an integral component bordering both the bottom edge and at least a part of the outer edge of said pane (50), (c) a profiled ledge (22,23) containing a drain channel (44) for water that is a part of said integral component that is on the backside of the panel (10) and which extends along both the bottom edge of said pane (50) and at least a part of a corner formed by the bottom and outer edges of said pane (50), said profiled ledge (22, 23) sloping continuously downwardly from a point adjacent said outer edge of said pane (50) towards said inner edge of said pane so that water arriving in said channel will flow toward the interior of the shower unit regardless of whether the shower door is open or closed, and (d) sealing means associated with the bottom edge of said integral component to seal off the passage of water from the backside to the front side of said panel.

2. Panel according to claim 1, wherein the integral profiled ledge (22, 23, 82, 92) sealingly encloses the associated edge(s) (21, 51, 81, 91) of the pane (50).

3. Panel according to claim 1, wherein the bottom of the ledge (22) carries a detachable sealing strip (26) which is vertically adjustable in a downwardly open longitudinal recess (24) of the profiled ledge (22).

4. Panel according to claim 3, wherein the sealing means (26) comprises a stiff support (28) that holds a flexible lip (32) and that is made of a hollow profile which form-fits a wider upper portion of the lip (32) and which includes at its end screwing apertures (30) parallel to the stiff support (28).

5. A panel according to claim 3, comprising latch means such as a slotted plate (34) for insertion into the bottom of the profiled ledge (22) at an end thereof transversely to the longitudinal recess (24), further comprising fixing means such as screws (36) for mounting the sealing strip (26) to the latch means, and comprising sealing plugs (38) for closing face ends of the longitudinal recess (24).

6. A panel according to claim 1 wherein the panel includes at its lower front corner a smoothly curved section.

7. A panel according to claim 1 wherein a hollow transition section (80) is provided for connection between the profiled ledges (22, 23) per se and the drain channels (44) per se.

8. A panel according to claim 1 wherein the front ledge (23) of the integral component extends at least up to the vertical center of the panel and forms outer handle means (42).

9. A panel according to claim 1 wherein the drain channel (44) extends at least up to the vertical center of the panel and forms inner handle means.

10. Panel according to claim 1 wherein the panel is mounted by a vertical mounting section (12) that includes a wall fixture (14) as well as a cover (18) that sealingly tops the wall fixture which holds the panel by hinges (56, 58).

11. A panel according to claim 1 wherein the profiled ledge (22, 23, 82, 92) is unilaterally affixed to the pane (50) by molding the ledge material thereto.

12. A panel according to claim 1 wherein each profiled ledge (22, 23) is of substantially lenticular cross section.

13. A panel according to claim 1 wherein the profiled ledge (22, 23, 82, 92) is a resilient expanded polyurethane or hard rubber.

14. A panel according to claim 1 wherein the panel front edges (46) have magnetic gib (48).

* * * * *